US009712940B2

(12) United States Patent
Rider et al.

(10) Patent No.: US 9,712,940 B2
(45) Date of Patent: Jul. 18, 2017

(54) AUTOMATIC AUDIO ADJUSTMENT BALANCE

(71) Applicant: Intel Corporation, Santa Clara, CA (US)

(72) Inventors: Tomer Rider, Naahryia (IL); Igor Tatourian, Fountain Hills, AZ (US)

(73) Assignee: Intel Corporation, Santa Clara, CA (US)

( * ) Notice: Subject to any disclaimer, the term of this patent is extended or adjusted under 35 U.S.C. 154(b) by 5 days.

(21) Appl. No.: 14/570,911

(22) Filed: Dec. 15, 2014

(65) Prior Publication Data

US 2016/0174011 A1 Jun. 16, 2016

(51) Int. Cl.
*H04R 5/02* (2006.01)
*H04S 7/00* (2006.01)

(52) U.S. Cl.
CPC ..... *H04S 7/303* (2013.01); *H04R 2499/11* (2013.01); *H04R 2499/15* (2013.01)

(58) Field of Classification Search
USPC ..... 381/303
See application file for complete search history.

(56) References Cited

U.S. PATENT DOCUMENTS 4,736,437 A * 4/1988 Sacks ..... G06K 9/3283 382/216
7,123,731 B2 10/2006 Cohen et al.
8,311,249 B2 11/2012 Koyama et al.
8,400,322 B2 3/2013 Acedo et al.
2008/0240474 A1* 10/2008 Sakamoto ..... H04R 5/02 381/300
2010/0027832 A1* 2/2010 Koseki ..... H04R 1/323 381/387
2011/0316967 A1 12/2011 Etter
2012/0114137 A1 5/2012 Tsurumi
2013/0342669 A1* 12/2013 Hsu ..... H04N 7/002 348/77
2013/0345969 A1* 12/2013 Udeshi ..... G01C 21/30 701/461

(Continued)

FOREIGN PATENT DOCUMENTS

WO WO-2016099821 A1 6/2016

OTHER PUBLICATIONS

"International Application Serial No. PCT/US2015/062363, International Search Report mailed Mar. 28, 2016", 3 pgs.

(Continued)

*Primary Examiner* — Quynh Nguyen
(74) *Attorney, Agent, or Firm* — Schwegman Lundberg & Woessner, P.A.

(57) ABSTRACT

Various systems and methods for automatically adjusting audio balance are described herein. A system for automatically adjusting audio balance includes a distance module to determine a distance from an audio speaker to an audience, the audio speaker being one of a plurality of audio speakers, an audio modification module to determine a modification to an audio characteristic of the audio speaker based on the distance, the modification to provide a balanced soundstage for the audience from the plurality of audio speakers, and a control module to apply the modification of the audio characteristic to the audio speaker.

24 Claims, 5 Drawing Sheets

(56) References Cited

U.S. PATENT DOCUMENTS

2014/0323156 A1* 10/2014 Gilberton ..... H04W 4/025
455/456.3
2015/0341738 A1* 11/2015 Lyons ..... H04R 5/04
381/306

OTHER PUBLICATIONS

"International Application Serial No. PCT/US2015/062363, Written Opinion mailed Mar. 28, 2016", 6 pgs.

* cited by examiner

AUTOMATIC AUDIO ADJUSTMENT BALANCE

TECHNICAL FIELD

Embodiments described herein generally relate to audio processing and in particular, to automatic audio adjustment balance.

BACKGROUND

A stereo speaker system includes at least two speakers to create a soundstage that creates an illusion of directionality and audible perspective. By using an arrangement of two or more loudspeakers with two or more independent audio channels, a performance may be reproduced providing the impression of sound heard from various directions, as in natural hearing. To accurately reproduce a soundstage, the speaker output should be balanced.

BRIEF DESCRIPTION OF THE DRAWINGS

In the drawings, which are not necessarily drawn to scale, like numerals may describe similar components in different views. Like numerals having different letter suffixes may represent different instances of similar components. Some embodiments are illustrated by way of example, and not limitation, in the figures of the accompanying drawings in which.

DETAILED DESCRIPTION

Systems and methods described herein provide mechanisms for automatic audio adjustment balance. Imaging describes the extent that a stereo system is able to reproduce the timbre and location of individual instruments accurately and realistically. To obtain superior imaging in a stereo system, the path lengths from the speakers to the listener should be as close to equal as possible. This arrangement ensures that the sound reaches the listener's ears at approximately the same time. The result is a balanced and robust soundstage, where the speakers seem to disappear, being replaced with a spatial arrangement of music sources.

To obtain the best soundstage when listening to music or other audio content, the listener should position themselves in the middle of the right and left speakers. However, in some cases, this is infeasible or impracticable. For example, when driving in a vehicle the speakers in the door closest to the listener (e.g., the left door in the United States) may appear to be louder when the stereo system is objectively balanced. This is because the listener is sitting a few feet closer to the speakers in the driver's door than the passenger's door and the speakers there. This physical arrangement creates a bias or imbalance in the soundstage and detracts from listening enjoyment. In a home theater setting, the listener may choose to sit on a chair or a couch, where the chair is closer to the left speaker and the couch is closer to the right. A similar distortion of the soundstage may occur.

To adjust a soundstage, various technologies have been developed. For example, digital time correction may be used. Time correction compensates for speaker placement by adjusting the speed at which the audio signal reaches individual speakers. The delay of sound to closer speakers results in having all the sounds arrive at the listener's ears at the same time.

However, balancing speakers, arranging speakers in a room, or digitally altering the timing all have the disadvantage of being static solutions. What is needed is a mechanism to provide a dynamically updatable soundstage based on the listener's position at any given time.

Figure 1:
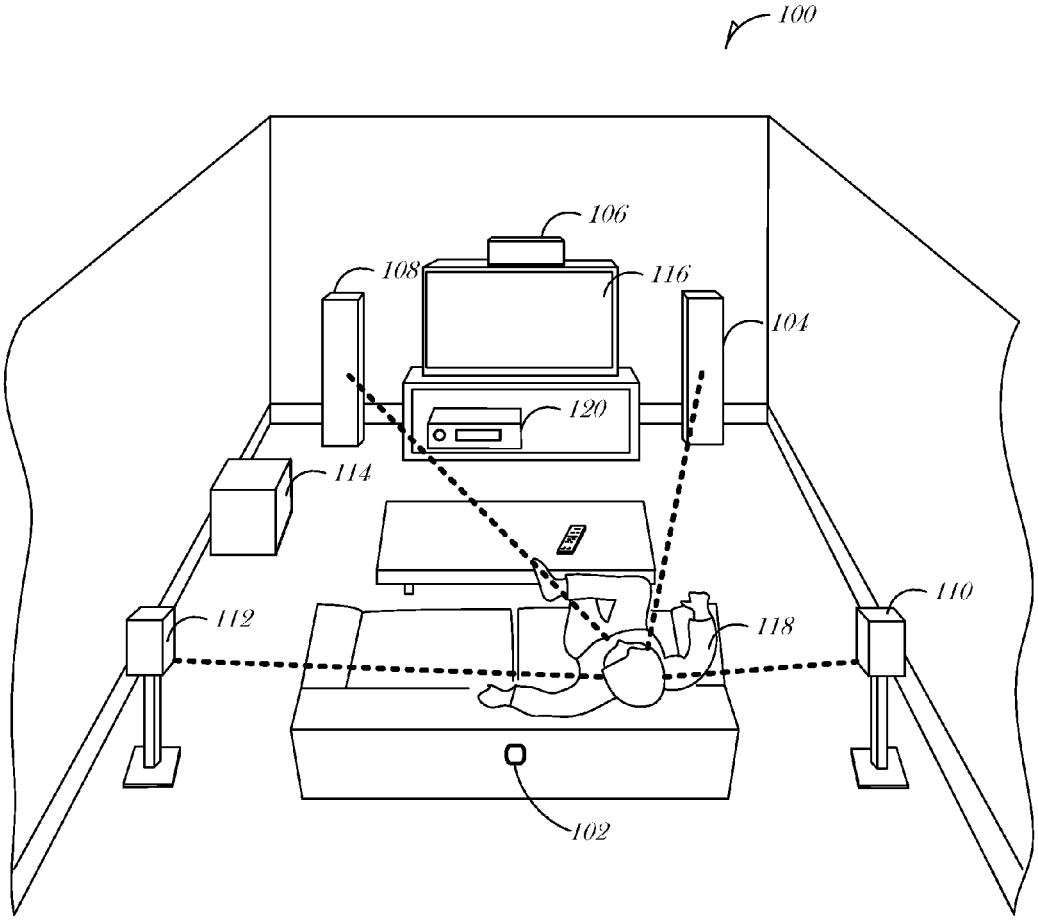
FIG. 1 is a schematic drawing illustrating a listening environment, according to an embodiment.

FIG. 1 is a schematic drawing illustrating a listening environment 100, according to an embodiment. The listening environment 100 includes a default listening position 102 and a plurality of speakers (e.g., speakers 104, 106, 108, 110, 112, and 114). In the listening environment 100 there is a front right speaker 104, a front center speaker 106, a front left speaker 108, a right rear speaker 110, a rear left speaker 112, and a subwoofer 114. In the example illustrated, there is also a display device 116 (e.g., a television); however, it is understood that the audio balancing mechanism described herein is separate from video playback mechanisms.

Typically, the front speakers (e.g., speakers 104, 106, and 108) are designed to output frequencies in a higher frequency range than other speakers (e.g., subwoofer 114 or rear speakers 110 and 112). These front speakers (e.g., speakers 104, 106, and 108) provide the majority of the soundstage imaging. As a result of the frequency ranges used, on average, the center channel reproduces 50% of an entire movie soundtrack and over 90% of the dialogue. Although of similar frequency range as the front speakers ((e.g., speakers 104, 106, and 108), the rear speakers (e.g., speakers 110 and 112) are not used as much in the sound mixing. The surround speakers (e.g., speakers 110 and 112) provide a rear soundstage that adds ambiance and depth to the soundstage (e.g., fills in the environmental sounds in a soundtrack). The subwoofer 114 provides the low frequency effects (e.g., explosions) and other low frequency dialog or sound. A crossover point is used to mix the low-range of the front speakers (e.g., speakers 104, 106, and 108) with the higher range of the subwoofer 114. Although only five speakers and a subwoofer are illustrated in FIG. 1, it is understood that the mechanism described herein may be applied to sound systems with any number of speakers or subwoofers.

The default listening position 102 may be initially configured, for example, when a sound system 120 is initially installed. However, the default listening position 102 may not coincide with the actual position of a listener 118. In the example illustrated in FIG. 1, the default listening position 102 was initialized at the center of the sofa. The listener 118 is sitting to the right of the default listening position 102 and is therefore not receiving the left channel audio (front left speaker 108 and rear left speaker 112) at the same time as the right channel audio (front right speaker 104 and rear right speaker 110) or with the same volume. As a result, the listener 118 is not hearing a balanced soundstage.

The listener's 118 actual position may be sensed by a variety of mechanisms. Using the listener's 118 actual position, the sound system 120 may adjust volume, timing, or other aspects of the audio output to balance the soundstage for the listener 118.

In an embodiment, each speaker (e.g., speakers 104, 106, 108, 110, and 112) except for the subwoofer 114 obtains a distance from the respective speaker to the listener 118 (represented with dashed lines in FIG. 1). Using the distance, the respective speaker adjusts a volume output. The distance may be determined using a sensor in the respective speaker, such as a micropower impulse radar (MIR), electric field sensor, vibration sensor, Doppler-shift sensor, or scanning range-finders.

In another embodiment, the listener 118 may wear or have in his possession a mobile device. In such an embodiment, the speakers (e.g., speakers 104, 106, 108, 110, and 112) may determine a distance from the respective speaker to the mobile device. For example, the mobile device may be a pair of smartglasses worn by the listener 118 and thus closely approximate the distance to the listener's ears. Distance may be calculated using various mechanisms, such as Wi-Fi trilateration or other location based service mechanism, round-trip timing, infrared sensor, camera-based systems, or other mechanisms. The mobile device may be any of a number of types of devices, including but not limited to a smartwatch, smartglasses, e-textile (e.g., smart shirt), smartphone, laptop, tablet, hybrid computer, remote control, or other portable or wearable devices.

In another embodiment, the distance to the listener 118 is determined from a single speaker and that distance is then communicated to other speakers, which based on previously measured distances, may adjust their volume or other audio characteristic to balance the soundstage. Alternatively, the "master" speaker may know the relative locations of the other speakers and provide a volume or audio characteristic to the other speakers to use.

In another embodiment, a camera mounted in the listening environment 100 is used to determine listener location or the direction the listener 118 is facing. For example, a 3D camera mounted in the display device 116 may be used to determine a vector including direction and distance.

In another embodiment, the direction the listener 118 is facing is also determined along with their distance(s) from speaker(s). The direction may be used to change roles of front speakers (e.g., speakers 104, 106, and 108) to rear speakers (e.g., speakers 110 and 112), and vice versa, in order to orient the soundstage to the direction the listener 118 is currently facing. A mobile device the listener 118 is holding or wearing may provide such information (e.g., using Bluetooth Low Energy to determine distance and a magnetometer to determine direction).

In the case where there are several people in a listening environment 100, the sound system may determine distances to each person and then average the distances to each speaker. In another embodiment, the sound system may determine a centroid of the people's locations and then use the centroid for calculating the distances for adjusting audio.

The distance measuring and directional mechanisms may operate continually, periodically, or at some schedule to sense people in a listening environment 100 and adjust the audio characteristics based on the distance or the direction. Also, while the listening environment 100 is illustrated as a room, it is understood that the listening environment 100 may be any environment including, but not limited to a room, vehicle, office, computer desktop, retail location, entertainment venue, or the like.

Figure 2:
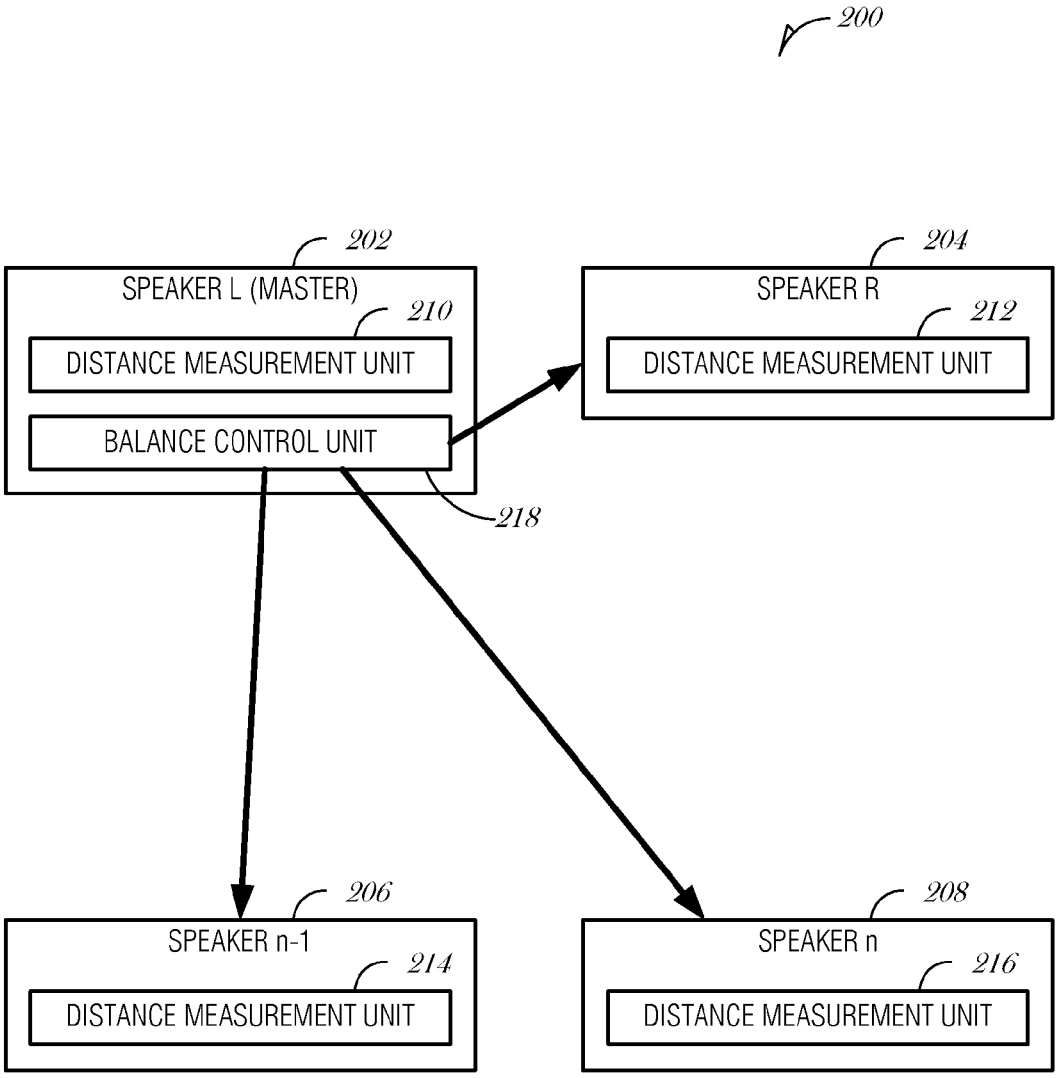
FIG. 2 is a schematic diagram illustrating a sound system, according to an embodiment.

FIG. 2 is a schematic diagram illustrating a sound system 200, according to an embodiment. The sound system 200 includes a front left speaker 202 acting as a master speaker, a front right speaker 204, and other speakers 206, 208. Each speaker (202, 204, 206, and 208) includes a distance measurement unit (210, 212, 214, and 216). In addition, the front left speaker 202 acting as the master speaker includes a balance control unit 218.

In operation, the speakers (204, 206, and 208) measure and communicate the distance to the person. The master speaker 202 also measures the distance to the person. Using the balance control unit 218, the front left speaker 202 determines the sound intensity being output at the front left speaker 202 and then calculates appropriate sound intensities for the other speakers (204, 206, and 208). The front left speaker 202 then communicates the appropriate sound intensities to the other speakers (204, 206, and 206), which adjust their output accordingly.

Figure 3:
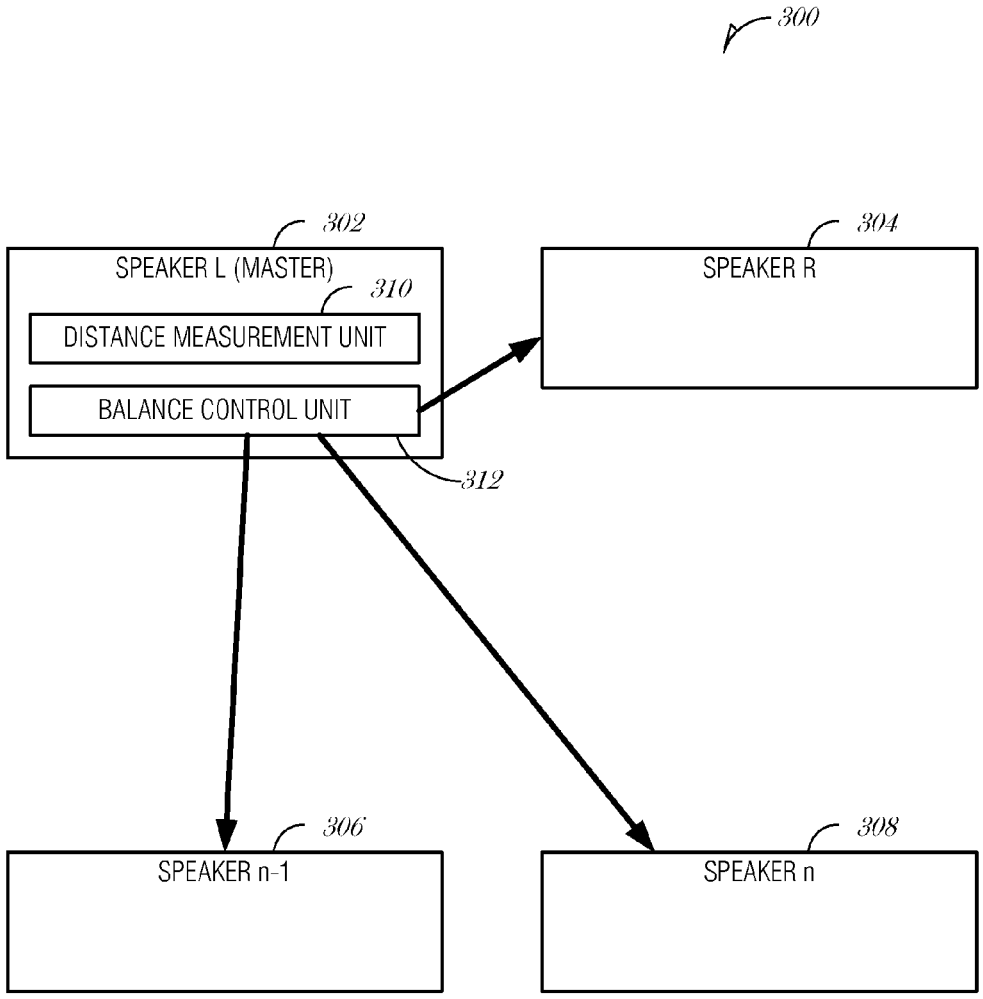
FIG. 3 is a schematic diagram illustrating a sound system, according to an embodiment.

FIG. 3 is a schematic diagram illustrating a sound system 300, according to an embodiment. The sound system 300 includes a front left speaker 302 acting as a master speaker, a front right speaker 304, and other speakers 306, 308. In contrast to the embodiment illustrated in FIG. 3, only the front left speaker 302 includes a distance measurement unit 310. In addition, the front left speaker 202 acting as the master speaker includes a balance control unit 312. During an installation or initialization phase, the front left speaker 302 may be provided the locations of the other speakers (304, 306, and 308). The locations may be provided as distance and direction (e.g., a vector) or by an absolute location (e.g., a latitude-longitude measured by GPS). The front left speaker 302 may measure the distance (and in some cases the direction) of a person in the environment. Then, the front left speaker 302 may calculate and communicate adjust adjustment information to the other speakers (304, 306, and 308) based on the location of the person and the locations of the other speakers (304, 306, and 308).

While FIG. 2 illustrates a master speaker arrangement with each speaker including distance measurement units, and FIG. 3 illustrates a different arrangement with just the master speaker having a distance measurement unit, it is understood that other combinations or permutations may be implemented. For example, another arrangement of speakers may include one master speaker with a distance measurement unit, two more speakers without distance measurement units, and a fourth speaker with its own distance measurement unit. In such an example, the master speaker may calculate audio modifications for the two without distance measurement units based on the previously-known locations of the two speakers. The master speaker may also use a previously-known location for the fourth speaker with a distance measurement unit, or may receive a location of a listener from the fourth speaker and use that data.

Figure 4:
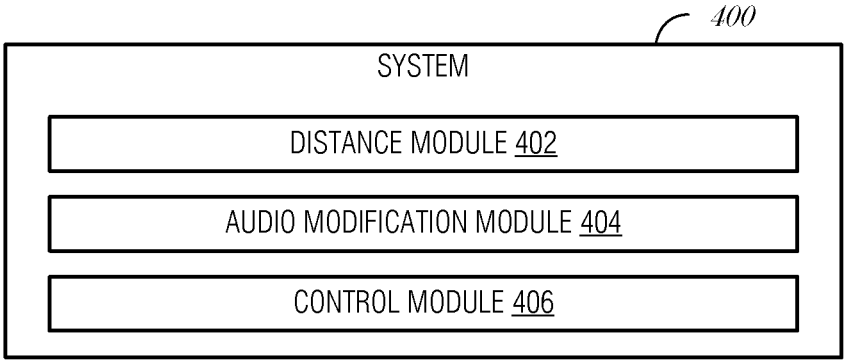
FIG. 4 is a block diagram illustrating a system for automatically adjusting audio balance, according to an embodiment.

FIG. 4 is a block diagram illustrating a system 400 for automatically adjusting audio balance, according to an embodiment. The system 400 may be embodied in a speaker, a head unit, a separate electronic component that interfaces with the head unit or receiver or speaker (e.g., a mobile phone or a dedicated stereo component), etc. The system 400 includes a distance module 402, an audio modification module 404, and a control module 406.

The distance module 402 may be configured to determine a distance from an audio speaker to an audience, the audio speaker being one of a plurality of audio speakers. It is understood that the audience may include a single person or multiple people. In an embodiment, to determine the distance, the distance module 402 is to detect a location of the audience from a sensor in the audio speaker and calculate the distance based on the location. In various embodiments, the sensor comprises one of: a camera, a micropower impulse radar, an electric field sensor, a vibration sensor, a Doppler-shift sensor, or a scanning range-finder.

In another embodiment, to detect the location of the audience, the distance module 402 is to detect a location of a mobile device of the audience. In an embodiment, to detect the location of the mobile device, the distance module 402 is to use a wireless trilateration mechanism to detect the location of the mobile device. For example, the distance module 402 may use a Wi-Fi location technique. In another embodiment, to detect the location of the mobile device, the distance module 402 is to access the location from a positioning system on the mobile device. The mobile device may be equipped with a positioning system (e.g., GPS or GLONASS) and may provide the latitude-longitude location of the mobile device to the distance module 402. The mobile device may be any type of computing device, and in various embodiments, the mobile device is one of: a smartphone, a wearable device, a remote control, or a mobile computer.

In an embodiment, the audience comprises a plurality of listeners, and to determine the distance from the audio speaker to the audience, the distance module 402 is to determine an average distance from the audio speaker to each of the plurality of listeners in the audience, and use the average distance for the distance.

In an embodiment, the audience comprises a plurality of listeners, and wherein to determine the distance from the audio speaker to the audience, the distance module 402 is to determine locations of each of the plurality of listeners in the audience, calculate a centroid of the plurality of listeners, and determine a distance from the audio speaker to the centroid.

In an embodiment, the audience comprises a plurality of listeners, and wherein to determine the distance from the audio speaker to the audience, the distance module 402 is to determine locations of each of the plurality of listeners in the audience, calculate a bell-shaped distribution of the plurality of listeners, and determine a distance from the audio speaker based on the bell-shaped distribution. A median value may be used to approximate the distance based on the bell-shaped distribution. For example, if there were three listeners in the audience and they were positioned 3 feet, 10 feet, and 9 feet from the speaker, a value of 9 feet (median value) may be used for audio adjustments.

The an audio modification module 404 may be configured to determine a modification to an audio characteristic of the audio speaker based on the distance, the modification to provide a balanced soundstage for the audience from the plurality of audio speakers. In an embodiment, the modification to the audio characteristic is based on the location of the audience. For example, if the location indicates that the audience is closer to one speaker than another, then the volume in the one speaker may be reduced or the volume in the other speaker may be increased.

In embodiments, the modification to the audio characteristic is one of an increase in volume, a decrease in volume, or a change in digital timing.

The control module 406 may be configured to apply the modification of the audio characteristic to the audio speaker. In an embodiment, the control module 406 is to apply the modification of the audio characteristic to the audio speaker automatically on a periodic basis. For example, every two minutes, every 30 minutes, or at some user-defined period, the system 400 may re-evaluate the location of the audience and reconfigure the audio characteristics based on the revised location.

In an embodiment, the control module 406 is to apply the modification of the audio characteristic when the distance from the audio speaker to the audience changes more than a threshold amount. For example, as the audience moves about the listening environment 100, the audio characteristics are updated to provide a dynamically adjusted soundstage.

In an embodiment, the system 400 includes a direction module to determine a direction the audience is facing. In such an embodiment, the modification to the audio characteristic is based on the direction the audience is facing. In an embodiment, the audio modification module 404 is to identify a front speaker having a front channel audio output and identify a rear speaker having a rear channel audio output. To apply the modification of the audio characteristic, the control module 406 is to swap the front channel audio output to the rear speaker, and the rear channel audio output to the front speaker when the direction the audience is facing is toward the rear speaker.

Figure 5:
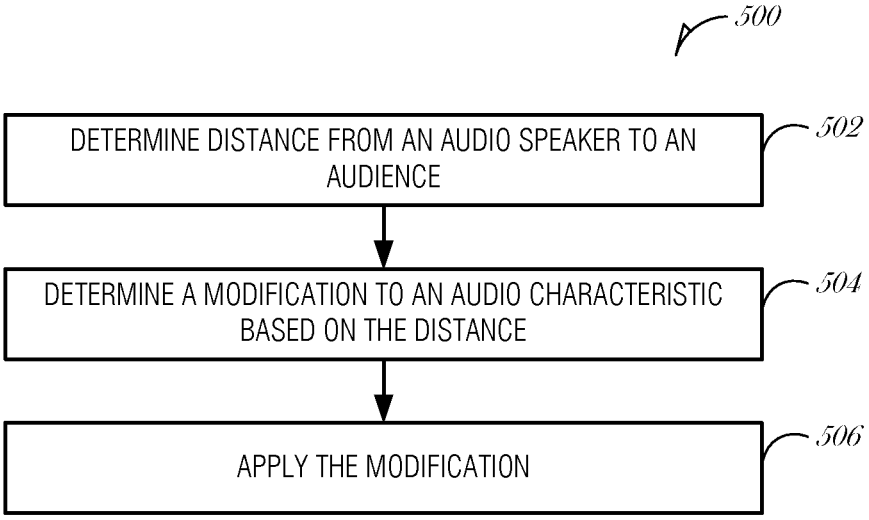
FIG. 5 is a flowchart illustrating a method of automatically adjusting audio balance, according to an embodiment.

FIG. 5 is a flowchart illustrating a method 500 of automatically adjusting audio balance, according to an embodiment. At block 502, a distance from an audio speaker to an audience is determined, the audio speaker being one of a plurality of audio speakers. In an embodiment, determining the distance comprises detecting a location of the audience from a sensor in the audio speaker and calculating the distance based on the location. In various embodiments, the sensor comprises one of: a camera, a micropower impulse radar, an electric field sensor, a vibration sensor, a Doppler-shift sensor, or a scanning range-finder.

In an embodiment, detecting the location of the audience comprises detecting a location of a mobile device of the audience. In a further embodiment, detecting the location of the mobile device comprises using a wireless trilateration mechanism to detect the location of the mobile device. In another embodiment, detecting the location of the mobile device comprises accessing the location from a positioning system on the mobile device. In various embodiments, the mobile device is one of: a smartphone, a wearable device, a remote control, or a mobile computer.

In an embodiment, the modification to the audio characteristic is based on the location of the audience.

At block 504, a modification to an audio characteristic of the audio speaker is determined based on the distance, the modification to provide a balanced soundstage for the audience from the plurality of audio speakers.

At block 506, the modification of the audio characteristic is applied to the audio speaker. In an embodiment, the modification to the audio characteristic is one of an increase in volume, a decrease in volume, or a change in digital timing.

In an embodiment, applying the modification of the audio characteristic to the audio speaker is automatically performed on a periodic basis.

In an embodiment, applying the modification of the audio characteristic is performed when the distance from the audio speaker to the audience changes more than a threshold amount. For example, if a person in the audience moves more than 3 feet, then the audio may be rebalanced using a modified audio characteristic.

In an embodiment, the audience comprises a plurality of listeners, and wherein determining the distance from the audio speaker to the audience comprises determining an average distance from the audio speaker to each of the plurality of listeners in the audience, and using the average distance for the distance.

In an embodiment, the audience comprises a plurality of listeners, and wherein determining the distance from the audio speaker to the audience comprises determining locations of each of the plurality of listeners in the audience, calculating a centroid of the plurality of listeners, and determining a distance from the audio speaker to the centroid.

In an embodiment, the audience comprises a plurality of listeners, and wherein determining the distance from the audio speaker to the audience comprises determining locations of each of the plurality of listeners in the audience, calculating a bell-shaped distribution of the plurality of listeners, and determining a distance from the audio speaker based on the bell-shaped distribution.

In a further embodiment, the method 500 includes determining a direction the audience is facing. In a further embodiment, the modification to the audio characteristic is based on the direction the audience is facing. In an embodiment, the modification to the audio characteristic comprises identifying a front speaker having a front channel audio output and identifying a rear speaker having a rear channel audio output; and in such an embodiment, applying the modification of the audio characteristic comprises swapping the front channel audio output to the rear speaker, and the rear channel audio output to the front speaker when the direction the audience is facing is toward the rear speaker.

Embodiments may be implemented in one or a combination of hardware, firmware, and software. Embodiments may also be implemented as instructions stored on a machine-readable storage device, which may be read and executed by at least one processor to perform the operations described herein. A machine-readable storage device may include any non-transitory mechanism for storing information in a form readable by a machine (e.g., a computer). For example, a machine-readable storage device may include read-only memory (ROM), random-access memory (RAM), magnetic disk storage media, optical storage media, flash-memory devices, and other storage devices and media.

Examples, as described herein, may include, or may operate on, logic or a number of components, modules, or mechanisms. Modules may be hardware, software, or firmware communicatively coupled to one or more processors in order to carry out the operations described herein. Modules may be hardware modules, and as such modules may be considered tangible entities capable of performing specified operations and may be configured or arranged in a certain manner. In an example, circuits may be arranged (e.g., internally or with respect to external entities such as other circuits) in a specified manner as a module. In an example, the whole or part of one or more computer systems (e.g., a standalone, client or server computer system) or one or more hardware processors may be configured by firmware or software (e.g., instructions, an application portion, or an application) as a module that operates to perform specified operations. In an example, the software may reside on a machine-readable medium. In an example, the software, when executed by the underlying hardware of the module, causes the hardware to perform the specified operations. Accordingly, the term hardware module is understood to encompass a tangible entity, be that an entity that is physically constructed, specifically configured (e.g., hardwired), or temporarily (e.g., transitorily) configured (e.g., programmed) to operate in a specified manner or to perform part or all of any operation described herein. Considering examples in which modules are temporarily configured, each of the modules need not be instantiated at any one moment in time. For example, where the modules comprise a general-purpose hardware processor configured using software; the general-purpose hardware processor may be configured as respective different modules at different times. Software may accordingly configure a hardware processor, for example, to constitute a particular module at one instance of time and to constitute a different module at a different instance of time. Modules may also be software or firmware modules, which operate to perform the methodologies described herein.

Figure 6:
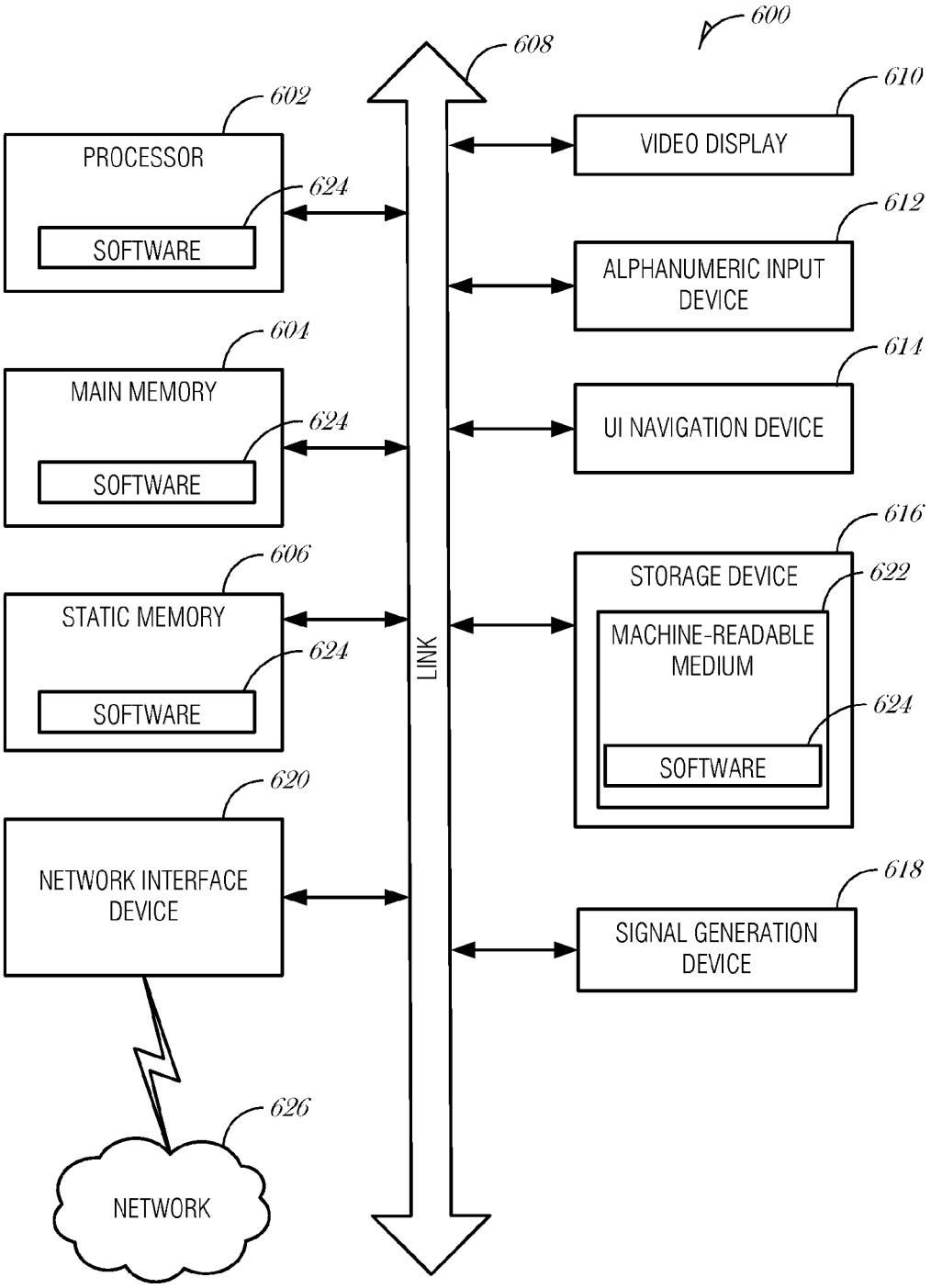
FIG. 6 is a block diagram illustrating an example machine upon which any one or more of the techniques (e.g., methodologies) discussed herein may perform, according to an example embodiment.

FIG. 6 is a block diagram illustrating a machine in the example form of a computer system 600, within which a set or sequence of instructions may be executed to cause the machine to perform any one of the methodologies discussed herein, according to an example embodiment. In alternative embodiments, the machine operates as a standalone device or may be connected (e.g., networked) to other machines. In a networked deployment, the machine may operate in the capacity of either a server or a client machine in server-client network environments, or it may act as a peer machine in peer-to-peer (or distributed) network environments. The machine may be an onboard vehicle system, set-top box, wearable device, personal computer (PC), a tablet PC, a hybrid tablet, a personal digital assistant (PDA), a mobile telephone, or any machine capable of executing instructions (sequential or otherwise) that specify actions to be taken by that machine. Further, while only a single machine is illustrated, the term "machine" shall also be taken to include any collection of machines that individually or jointly execute a set (or multiple sets) of instructions to perform any one or more of the methodologies discussed herein. Similarly, the term "processor-based system" shall be taken to include any set of one or more machines that are controlled by or operated by a processor (e.g., a computer) to individually or jointly execute instructions to perform any one or more of the methodologies discussed herein.

Example computer system 600 includes at least one processor 602 (e.g., a central processing unit (CPU), a graphics processing unit (GPU) or both, processor cores, compute nodes, etc.), a main memory 604 and a static memory 606, which communicate with each other via a link 608 (e.g., bus). The computer system 600 may further include a video display unit 610, an alphanumeric input device 612 (e.g., a keyboard), and a user interface (UI) navigation device 614 (e.g., a mouse). In one embodiment, the video display unit 610, input device 612 and UI navigation device 614 are incorporated into a touch screen display. The computer system 600 may additionally include a storage device 616 (e.g., a drive unit), a signal generation device 618 (e.g., a speaker), a network interface device 620, and one or more sensors (not shown), such as a global positioning system (GPS) sensor, compass, accelerometer, or other sensor.

The storage device 616 includes a machine-readable medium 622 on which is stored one or more sets of data structures and instructions 624 (e.g., software) embodying or utilized by any one or more of the methodologies or functions described herein. The instructions 624 may also reside, completely or at least partially, within the main memory 604, static memory 606, and/or within the processor 602 during execution thereof by the computer system 600, with the main memory 604, static memory 606, and the processor 602 also constituting machine-readable media.

While the machine-readable medium 622 is illustrated in an example embodiment to be a single medium, the term "machine-readable medium" may include a single medium or multiple media (e.g., a centralized or distributed database, and/or associated caches and servers) that store the one or more instructions 624. The term "machine-readable medium" shall also be taken to include any tangible medium that is capable of storing, encoding or carrying instructions for execution by the machine and that cause the machine to perform any one or more of the methodologies of the present disclosure or that is capable of storing, encoding or carrying data structures utilized by or associated with such instructions. The term "machine-readable medium" shall accordingly be taken to include, but not be limited to, solid-state memories, and optical and magnetic media. Specific examples of machine-readable media include non-volatile memory, including but not limited to, by way of example, semiconductor memory devices (e.g., electrically programmable read-only memory (EPROM), electrically erasable programmable read-only memory (EEPROM)) and flash memory devices; magnetic disks such as internal hard disks and removable disks; magneto-optical disks; and CD-ROM and DVD-ROM disks.

The instructions 624 may further be transmitted or received over a communications network 626 using a transmission medium via the network interface device 620 utilizing any one of a number of well-known transfer protocols (e.g., HTTP). Examples of communication networks include a local area network (LAN), a wide area network (WAN), the Internet, mobile telephone networks, plain old telephone (POTS) networks, and wireless data networks (e.g., Wi-Fi, 3G, and 4G LTE/LTE-A or WiMAX networks). The term "transmission medium" shall be taken to include any intangible medium that is capable of storing, encoding, or carrying instructions for execution by the machine, and includes digital or analog communications signals or other intangible medium to facilitate communication of such software.

ADDITIONAL NOTES & EXAMPLES

Example 1 includes subject matter for automatically adjusting audio balance (such as a device, apparatus, or machine) comprising: a distance module to determine a distance from an audio speaker to an audience, the audio speaker being one of a plurality of audio speakers; an audio modification module to determine a modification to an audio characteristic of the audio speaker based on the distance, the modification to provide a balanced soundstage for the audience from the plurality of audio speakers; and a control module to apply the modification of the audio characteristic to the audio speaker.

In Example 2, the subject matter of Example 1 may include, wherein to determine the distance, the distance module is to: detect a location of the audience from a sensor in the audio speaker; and calculate the distance based on the location.

In Example 3, the subject matter of any one of Examples 1 to 2 may include, wherein the sensor comprises one of: a camera, a micropower impulse radar, an electric field sensor, a vibration sensor, a Doppler-shift sensor, or a scanning range-finder.

In Example 4, the subject matter of any one of Examples 1 to 3 may include, wherein to detect the location of the audience, the distance module is to detect a location of a mobile device of the audience.

In Example 5, the subject matter of any one of Examples 1 to 4 may include, wherein to detect the location of the mobile device, the distance module is to use a wireless trilateration mechanism to detect the location of the mobile device.

In Example 6, the subject matter of any one of Examples 1 to 5 may include, wherein to detect the location of the mobile device, the distance module is to access the location from a positioning system on the mobile device.

In Example 7, the subject matter of any one of Examples 1 to 6 may include, wherein the mobile device is one of: a smartphone, a wearable device, a remote control, or a mobile computer.

In Example 8, the subject matter of any one of Examples 1 to 7 may include, wherein the modification to the audio characteristic is based on the location of the audience.

In Example 9, the subject matter of any one of Examples 1 to 8 may include, a direction module to determine a direction the audience is facing.

In Example 10, the subject matter of any one of Examples 1 to 9 may include, wherein the modification to the audio characteristic is based on the direction the audience is facing.

In Example 11, the subject matter of any one of Examples 1 to 10 may include, wherein the audio modification module is to: identify a front speaker having a front channel audio output; and identify a rear speaker having a rear channel audio output; and wherein to apply the modification of the audio characteristic, the control module is to: swap the front channel audio output to the rear speaker, and the rear channel audio output to the front speaker when the direction the audience is facing is toward the rear speaker.

In Example 12, the subject matter of any one of Examples 1 to 11 may include, wherein the modification to the audio characteristic is one of an increase in volume, a decrease in volume, or a change in digital timing.

In Example 13, the subject matter of any one of Examples 1 to 12 may include, wherein the control module is to apply the modification of the audio characteristic to the audio speaker automatically on a periodic basis.

In Example 14, the subject matter of any one of Examples 1 to 13 may include, wherein the control module is to apply the modification of the audio characteristic when the distance from the audio speaker to the audience changes more than a threshold amount.

In Example 15, the subject matter of any one of Examples 1 to 14 may include, wherein the audience comprises a plurality of listeners, and wherein to determine the distance from the audio speaker to the audience, the distance module is to determine an average distance from the audio speaker to each of the plurality of listeners in the audience, and use the average distance for the distance.

In Example 16, the subject matter of any one of Examples 1 to 15 may include, wherein the audience comprises a plurality of listeners, and wherein to determine the distance from the audio speaker to the audience, the distance module is to: determine locations of each of the plurality of listeners in the audience; calculate a centroid of the plurality of listeners; and determine a distance from the audio speaker to the centroid.

In Example 17, the subject matter of any one of Examples 1 to 16 may include, wherein the audience comprises a plurality of listeners, and wherein to determine the distance from the audio speaker to the audience, the distance module is to: determine locations of each of the plurality of listeners in the audience; calculate a bell-shaped distribution of the plurality of listeners; and determine a distance from the audio speaker based on the bell-shaped distribution.

Example 18 includes subject matter for automatically adjusting audio balance (such as a method, means for performing acts, machine readable medium including instructions that when performed by a machine cause the machine to performs acts, or an apparatus to perform) comprising: determining a distance from an audio speaker to an audience, the audio speaker being one of a plurality of audio speakers; determining a modification to an audio characteristic of the audio speaker based on the distance, the modification to provide a balanced soundstage for the audience from the plurality of audio speakers; and applying the modification of the audio characteristic to the audio speaker.

In Example 19, the subject matter of Example 18 may include, wherein determining the distance comprises: detecting a location of the audience from a sensor in the audio speaker; and calculating the distance based on the location.

In Example 20, the subject matter of any one of Examples 18 to 19 may include, wherein the sensor comprises one of: a camera, a micropower impulse radar, an electric field sensor, a vibration sensor, a Doppler-shift sensor, or a scanning range-finder.

In Example 21, the subject matter of any one of Examples 18 to 20 may include, wherein detecting the location of the audience comprises detecting a location of a mobile device of the audience.

In Example 22, the subject matter of any one of Examples 18 to 21 may include, wherein detecting the location of the mobile device comprises using a wireless trilateration mechanism to detect the location of the mobile device.

In Example 23, the subject matter of any one of Examples 18 to 22 may include, wherein detecting the location of the mobile device comprises accessing the location from a positioning system on the mobile device.

In Example 24, the subject matter of any one of Examples 18 to 23 may include, wherein the mobile device is one of: a smartphone, a wearable device, a remote control, or a mobile computer.

In Example 25, the subject matter of any one of Examples 18 to 24 may include, wherein the modification to the audio characteristic is based on the location of the audience.

In Example 26, the subject matter of any one of Examples 18 to 25 may include, determining a direction the audience is facing.

In Example 27, the subject matter of any one of Examples 18 to 26 may include, wherein the modification to the audio characteristic is based on the direction the audience is facing.

In Example 28, the subject matter of any one of Examples 18 to 27 may include, wherein the modification to the audio characteristic comprises: identifying a front speaker having a front channel audio output; and identifying a rear speaker having a rear channel audio output; and wherein applying the modification of the audio characteristic comprises: swapping the front channel audio output to the rear speaker, and the rear channel audio output to the front speaker when the direction the audience is facing is toward the rear speaker.

In Example 29, the subject matter of any one of Examples 18 to 28 may include, wherein the modification to the audio characteristic is one of an increase in volume, a decrease in volume, or a change in digital timing.

In Example 30, the subject matter of any one of Examples 18 to 29 may include, wherein applying the modification of the audio characteristic to the audio speaker is automatically performed on a periodic basis.

In Example 31, the subject matter of any one of Examples 18 to 30 may include, wherein applying the modification of the audio characteristic is performed when the distance from the audio speaker to the audience changes more than a threshold amount.

In Example 32, the subject matter of any one of Examples 18 to 31 may include, wherein the audience comprises a plurality of listeners, and wherein determining the distance from the audio speaker to the audience comprises determining an average distance from the audio speaker to each of the plurality of listeners in the audience, and using the average distance for the distance.

In Example 33, the subject matter of any one of Examples 18 to 32 may include, wherein the audience comprises a plurality of listeners, and wherein determining the distance from the audio speaker to the audience comprises: determining locations of each of the plurality of listeners in the audience; calculating a centroid of the plurality of listeners; and determining a distance from the audio speaker to the centroid.

In Example 34, the subject matter of any one of Examples 18 to 33 may include, wherein the audience comprises a plurality of listeners, and wherein determining the distance from the audio speaker to the audience comprises: determining locations of each of the plurality of listeners in the audience; calculating a bell-shaped distribution of the plurality of listeners; and determining a distance from the audio speaker based on the bell-shaped distribution.

Example 35 includes at least one machine-readable medium including instructions, which when executed by a machine, cause the machine to perform operations of any of the Examples 18-34.

Example 36 includes an apparatus comprising means for performing any of the Examples 18-34.

Example 37 includes subject matter for automatically adjusting audio balance (such as a device, apparatus, or machine) comprising: means for determining a distance from an audio speaker to an audience, the audio speaker being one of a plurality of audio speakers; means for determining a modification to an audio characteristic of the audio speaker based on the distance, the modification to provide a balanced soundstage for the audience from the plurality of audio speakers; and means for applying the modification of the audio characteristic to the audio speaker.

In Example 38, the subject matter of Example 37 may include, wherein the means for determining the distance comprise: means for detecting a location of the audience from a sensor in the audio speaker; and means for calculating the distance based on the location.

In Example 39, the subject matter of any one of Examples 37 to 38 may include, wherein the sensor comprises one of: a camera, a micropower impulse radar, an electric field sensor, a vibration sensor, a Doppler-shift sensor, or a scanning range-finder.

In Example 40, the subject matter of any one of Examples 37 to 39 may include, wherein the means for detecting the location of the audience comprise means for detecting a location of a mobile device of the audience.

In Example 41, the subject matter of any one of Examples 37 to 40 may include, wherein the means for detecting the location of the mobile device comprise means for using a wireless trilateration mechanism to detect the location of the mobile device.

In Example 42, the subject matter of any one of Examples 37 to 41 may include, wherein the means for detecting the location of the mobile device comprise means for accessing the location from a positioning system on the mobile device.

In Example 43, the subject matter of any one of Examples 37 to 42 may include, wherein the mobile device is one of: a smartphone, a wearable device, a remote control, or a mobile computer.

In Example 44, the subject matter of any one of Examples 37 to 43 may include, wherein the modification to the audio characteristic is based on the location of the audience.

In Example 45, the subject matter of any one of Examples 37 to 44 may include, means for determining a direction the audience is facing.

In Example 46, the subject matter of any one of Examples 37 to 45 may include, wherein the modification to the audio characteristic is based on the direction the audience is facing.

In Example 47, the subject matter of any one of Examples 37 to 46 may include, wherein the modification to the audio characteristic comprises: means for identifying a front speaker having a front channel audio output; and means for identifying a rear speaker having a rear channel audio output; and wherein the means for applying the modification of the audio characteristic comprise: means for swapping the front channel audio output to the rear speaker, and the rear channel audio output to the front speaker when the direction the audience is facing is toward the rear speaker.

In Example 48, the subject matter of any one of Examples 37 to 47 may include, wherein the modification to the audio characteristic is one of an increase in volume, a decrease in volume, or a change in digital timing.

In Example 49, the subject matter of any one of Examples 37 to 48 may include, wherein the means for applying the modification of the audio characteristic to the audio speaker is automatically performed on a periodic basis.

In Example 50, the subject matter of any one of Examples 37 to 49 may include, wherein the means for applying the modification of the audio characteristic is performed when the distance from the audio speaker to the audience changes more than a threshold amount.

In Example 51, the subject matter of any one of Examples 37 to 50 may include, wherein the audience comprises a plurality of listeners, and wherein the means for determining the distance from the audio speaker to the audience comprise means for determining an average distance from the audio speaker to each of the plurality of listeners in the audience and using the average distance for the distance.

In Example 52, the subject matter of any one of Examples 37 to 51 may include, wherein the audience comprises a plurality of listeners, and wherein the means for determining the distance from the audio speaker to the audience comprise: means for determining locations of each of the plurality of listeners in the audience; means for calculating a centroid of the plurality of listeners; and means for determining a distance from the audio speaker to the centroid.

In Example 53, the subject matter of any one of Examples 37 to 52 may include, wherein the audience comprises a plurality of listeners, and wherein the means for determining the distance from the audio speaker to the audience comprise: means for determining locations of each of the plurality of listeners in the audience; means for calculating a bell-shaped distribution of the plurality of listeners; and determining a distance from the audio speaker based on the bell-shaped distribution.

The above detailed description includes references to the accompanying drawings, which form a part of the detailed description. The drawings show, by way of illustration, specific embodiments that may be practiced. These embodiments are also referred to herein as "examples." Such examples may include elements in addition to those shown or described. However, also contemplated are examples that include the elements shown or described. Moreover, also contemplated are examples using any combination or permutation of those elements shown or described (or one or more aspects thereof), either with respect to a particular example (or one or more aspects thereof), or with respect to other examples (or one or more aspects thereof) shown or described herein.

In the event of inconsistent usages between this document and those documents so incorporated by reference, the usage in the incorporated reference(s) are supplementary to that of this document; for irreconcilable inconsistencies, the usage in this document controls.

In this document, the terms "a" or "an" are used, as is common in patent documents, to include one or more than one, independent of any other instances or usages of "at least one" or "one or more." In this document, the term "or" is used to refer to a nonexclusive or, such that "A or B" includes "A but not B," "B but not A," and "A and B," unless otherwise indicated. In the appended claims, the terms "including" and "in which" are used as the plain-English equivalents of the respective terms "comprising" and "wherein." Also, in the following claims, the terms "including" and "comprising" are open-ended, that is, a system, device, article, or process that includes elements in addition to those listed after such a term in a claim are still deemed to fall within the scope of that claim. Moreover, in the following claims, the terms "first," "second," and "third," etc. are used merely as labels, and are not intended to suggest a numerical order for their objects.

The above description is intended to be illustrative, and not restrictive. For example, the above-described examples (or one or more aspects thereof) may be used in combination with others. Other embodiments may be used, such as by one of ordinary skill in the art upon reviewing the above description. The Abstract is to allow the reader to quickly ascertain the nature of the technical disclosure. It is submitted with the understanding that it will not be used to interpret or limit the scope or meaning of the claims. Also, in the above Detailed Description, various features may be grouped together to streamline the disclosure. However, the claims may not set forth every feature disclosed herein as embodiments may feature a subset of said features. Further, embodiments may include fewer features than those disclosed in a particular example. Thus, the following claims are hereby incorporated into the Detailed Description, with a claim standing on its own as a separate embodiment. The scope of the embodiments disclosed herein is to be determined with reference to the appended claims, along with the full scope of equivalents to which such claims are entitled.

What is claimed is:

1. A system for automatically adjusting audio balance, the system comprising:

a distance module to determine a distance from an audio speaker to an audience, the audio speaker being one of a plurality of audio speakers, wherein the audience comprises a plurality of listeners, and wherein to determine the distance from the audio speaker to the audience, the distance module is to:

determine locations of each of the plurality of listeners in the audience;

calculate a centroid of the plurality of listeners; and determine a distance from the audio speaker to the centroid;

an audio modification module to determine a modification to an audio characteristic of the audio speaker based on the distance, the modification to provide a balanced soundstage for the audience from the plurality of audio speakers, wherein the modification to the audio characteristic includes a change in digital timing; and a control module to apply the modification of the audio characteristic to the audio speaker.

2. The system of claim 1, wherein to determine the distance, the distance module is to:

detect a location of the audience from a sensor in the audio speaker; and calculate the distance based on the location.

3. The system of claim 2, wherein the sensor comprises one of:

a camera, a micropower impulse radar, an electric field sensor, a vibration sensor, a Doppler-shift sensor, or a scanning range-finder.

4. The system of claim 2, wherein to detect the location of the audience, the distance module is to detect a location of a mobile device of the audience.

5. The system of claim 4, wherein to detect the location of the mobile device, the distance module is to use a wireless trilateration mechanism to detect the location of the mobile device.

6. The system of claim 4, wherein to detect the location of the mobile device, the distance module is to access the location from a positioning system on the mobile device.

7. The system of claim 4, wherein the mobile device is one of:

a smartphone, a wearable device, a remote control, or a mobile computer.

8. The system of claim 2, wherein the modification to the audio characteristic is based on the location of the audience.

9. The system of claim 2, further comprising a direction module to determine a direction the audience is facing.

10. The system of claim 9, wherein the modification to the audio characteristic is based on the direction the audience is facing.

11. The system of claim 10, wherein the audio modification module is to:

identify a front speaker having a front channel audio output; and identify a rear speaker having a rear channel audio output; and wherein to apply the modification of the audio characteristic, the control module is to:

swap the front channel audio output to the rear speaker, and the rear channel audio output to the front speaker when the direction the audience is facing is toward the rear speaker.

12. The system of claim 1, wherein the modification to the audio characteristic is further includes one of an increase in volume or a decrease in volume.

13. The system of claim 1, wherein the control module is to apply the modification of the audio characteristic to the audio speaker automatically on a periodic basis.

14. The system of claim 1, wherein the control module is to apply the modification of the audio characteristic when the distance from the audio speaker to the audience changes more than a threshold amount.

15. The system of claim 1, wherein the audience comprises a plurality of listeners, and wherein to determine the distance from the audio speaker to the audience, the distance module is to determine an average distance from the audio speaker to each of the plurality of listeners in the audience and use the average distance for the distance.

16. The system of claim 1, wherein the audience comprises a plurality of listeners, and wherein to determine the distance from the audio speaker to the audience, the distance module is to:

determine locations of each of the plurality of listeners in the audience;

calculate a bell-shaped distribution of the plurality of listeners; and determine a distance from the audio speaker based on the bell-shaped distribution.

17. A method of automatically adjusting audio balance, the method comprising:

determining a distance from an audio speaker to an audience, the audio speaker being one of a plurality of audio speakers, wherein the audience comprises a plurality of listeners, and wherein determining the distance from the audio speaker to the audience comprises:

determining locations of each of the plurality of listeners in the audience;

calculating a centroid of the plurality of listeners; and determining a distance from the audio speaker to the centroid;

determining a modification to an audio characteristic of the audio speaker based on the distance, the modification to provide a balanced soundstage for the audience from the plurality of audio speakers, wherein the modification to the audio characteristic includes a change in digital timing; and applying the modification of the audio characteristic to the audio speaker.

18. The method of claim 17, wherein determining the distance comprises:

detecting a location of the audience from a sensor in the audio speaker; and calculating the distance based on the location.

19. The method of claim 18, wherein the sensor comprises one of:

a camera, a micropower impulse radar, an electric field sensor, a vibration sensor, a Doppler-shift sensor, or a scanning range-finder.

20. At least one machine-readable medium including instructions for automatically adjusting audio balance, which when executed by a machine, cause the machine to:

determine a distance from an audio speaker to an audience, the audio speaker being one of a plurality of audio speakers;

determine a modification to an audio characteristic of the audio speaker based on the distance, the modification to provide a balanced soundstage for the audience from the plurality of audio speakers, wherein the modification to the audio characteristic includes a change in digital timing; and apply the modification of the audio characteristic to the audio speaker, wherein the audience comprises a plurality of listeners, and wherein the instructions to determine the distance include instructions, which when executed by the machine, cause the machine to:

determine locations of each of the plurality of listeners in the audience;

calculate a centroid of the plurality of listeners; and determine a distance from the audio speaker to the centroid.

21. The at least one machine-readable medium of claim 20, wherein the modification to the audio characteristic is one of an increase in volume, a decrease in volume, or a change in digital timing.

22. The at least one machine-readable medium of claim 20, wherein the instructions to apply the modification of the audio characteristic to the audio speaker are automatically performed on a periodic basis.

23. The at least one machine-readable medium of claim 20, wherein the instructions to apply the modification of the audio characteristic are performed when the distance from the audio speaker to the audience changes more than a threshold amount.

24. The at least one machine-readable medium of claim 20, wherein the audience comprises a plurality of listeners, and wherein the instructions to determine the distance from the audio speaker to the audience comprise instructions to determine an average distance from the audio speaker to each of the plurality of listeners in the audience and use the average distance for the distance.

* * * * *